US007333885B2

(12) United States Patent
Kakuya et al.

(10) Patent No.: US 7,333,885 B2
(45) Date of Patent: Feb. 19, 2008

(54) ENGINE CONTROL UNIT

(75) Inventors: Hiromu Kakuya, Hitachi (JP); Shiro Yamaoka, Hitachi (JP); Atsushi Shimada, Hitachinaka (JP); Shinya Satou, Hitachinaka (JP); Kunihiko Suzuki, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/442,157

(22) Filed: May 30, 2006

(65) Prior Publication Data

US 2006/0271266 A1 Nov. 30, 2006

(30) Foreign Application Priority Data

May 31, 2005 (JP) ..... 2005-160266

(51) Int. Cl.
*F02D 15/04* (2006.01)

(52) U.S. Cl. ..... 701/102

(58) Field of Classification Search ..... 701/102, 701/103, 105, 107; 123/295, 299, 300, 305, 123/480, 350
See application file for complete search history.

(56) References Cited

U.S. PATENT DOCUMENTS 5,967,114 A * 10/1999 Yasuoka ..... 123/295
5,979,397 A * 11/1999 Machida et al. ..... 123/295
5,983,854 A * 11/1999 Machida et al. ..... 701/107
5,996,547 A * 12/1999 Machida et al. ..... 123/295
6,024,069 A * 2/2000 Yoshino ..... 701/103
6,026,781 A 2/2000 Imatake et al.
6,267,095 B1 * 7/2001 Ikeda et al. ..... 123/295
6,644,019 B2 * 11/2003 Morikawa et al. ..... 123/300
6,708,668 B2 * 3/2004 Yoshida et al. ..... 123/295

FOREIGN PATENT DOCUMENTS

EP 0 962 371 A1 12/1999
JP 2003-201876 A 7/2003
JP 2003-293817 A 10/2003
JP 2004-011539 A 1/2004
JP 2004-27943 A 1/2004
JP 2004-027959 A 1/2004
JP 2004-346855 A 12/2004
JP 2005-98186 A 4/2005
WO WO 2004/055350 A1 7/2004

OTHER PUBLICATIONS

European Search Report dated Aug. 21, 2006 (Seven (7) pages).

* cited by examiner

*Primary Examiner*—Hieu T. Vo
(74) *Attorney, Agent, or Firm*—Crowell & Moring LLP

(57) ABSTRACT

There is provided an engine control unit to ensure operational performance and safety performance of a vehicle by carrying out switchover of combustion according to an operating condition of a vehicle (automobile). A vehicle peripheral condition such as vehicular gap, etc., a traveling geographical state, a condition that ensures vehicle stability, etc. are acquired, and switchover of combustion, for example, switchover between compression ignition combustion and spark ignition combustion is effected correspondingly.

4 Claims, 9 Drawing Sheets

ENGINE CONTROL UNIT

BACKGROUND OF THE INVENTION

1. Field of the Invention

The present invention relates to an engine control unit, and more particular, to a control unit that controls a combustion system for vehicular internal combustion engines, in which a combustion system such as spark ignition combustion, compression ignition combustion, etc. can be switched over.

2. Description of Related Art

Among internal combustion engines (referred below to engine) used for automobiles, etc., attention has been paid to a compression ignition type gasoline engine (referred below to as compression ignition engine), which compresses a mixture to cause self ignition combustion (referred below to as compression ignition combustion) and makes an improvement in fuel consumption performance and an improvement in exhaust performance compatible with each other.

A compression ignition engine that performs compression ignition combustion (first combustion system) can realize making fuel consumption performance and exhaust performance compatible with each other since high efficiency by high compression and lean combustion reduce fuel consumption to exhibit an excellent fuel economy and low temperature combustion of a mixture reduces emission of NOx as compared with a spark ignition engine, in which sparks from an ignition plug ignite and burns a mixture.

Compression ignition combustion in gasoline engines can be materialized in low load-low engine speed. Therefore, compression ignition engines make it necessary to carry out compression ignition combustion and spark ignition combustion (second combustion system) and to switch over between the combustion modes.

Switchover of compression in the related art is carried out judging whether switchover is possible, on the basis of a map decided by engine load and engine speed (for example, JP-A-2003-201876 and JP-A-2004-27959).

Also, in addition to the map of engine load and engine speed, in order to prevent combustion from becoming unstable in sensing emergency braking, it has been proposed to switch over between combustion modes from compression ignition combustion to spark ignition combustion (for example, JP-A-2004-11539).

That is, switchover of compression in the related art is mainly judged on the basis of an operating state of an engine.

However, safety performance and operational performance are not ensured in some vehicles, to which the related art is applied. The reason for this is that switchover between combustion modes, which is optimum for a vehicle, cannot be realized in some cases since switchover between compression ignition combustion and spark ignition combustion is judged.carried out on the basis of an operating state of an engine.

Under, for example, an operating condition that acceleration is frequently carried out in that range of engine load, in which compression ignition combustion is made possible, by virtue of an output of compression ignition combustion being low in responsibility, response to a demanded load cannot be in some cases realized to ensure an operational performance.

Also, likewise, by virtue of an output of compression ignition combustion being low in responsibility, a demand for engine load from a control unit for improvement of a vehicle in stability cannot be in some cases realized to ensure a safety performance of a vehicle.

SUMMARY OF THE INVENTION

The invention has been thought of in view of the problem and has its object to provide a control unit for vehicular internal combustion engines, in which a vehicle can be improved in safety performance and operational performance by realizing switchover between combustion modes according to an operation condition of the vehicle.

An engine control unit for internal combustion engines, according to the invention, comprises an engine control unit for internal combustion engines of vehicles, in which a plurality of combustion systems are carried out, the engine control unit comprising detection means for directly or indirectly detecting a condition having an influence on an operation of a vehicle, on which the internal combustion engine is mounted, and combustion switchover means for controlling to switch over a combustion mode of the internal combustion engine on the basis of results of detection made by the detection means.

With the engine control unit for internal combustion engines, according to the invention, the plurality of combustion systems include a first combustion system being low in combustion stability but excellent in fuel economy, and a second combustion system being inferior in fuel economy to the first combustion system but high in combustion stability, and the combustion switchover means includes a control condition for switchover of a combustion mode of the internal combustion engine according to an operating state of the internal combustion engine and controls to switch a combustion mode of the internal combustion engine over to the second combustion system on the basis of results of detection made by the detection means even when the internal combustion engine is put in an operating state to enable carrying out the first combustion system.

An engine control unit for internal combustion engines, according to the invention, comprises an engine control unit for internal combustion engines of vehicles, in which a plurality of combustion modes are carried out, the engine control unit comprising detection means that directly or indirectly detects a condition having an influence on an operation of a vehicle, on which the internal combustion engine is mounted, vehicle influence estimation means that estimates and calculates an influence on an operation of the vehicle on the basis of results of detection made by the detection means, and combustion switchover means that controls to switch over a combustion mode of the internal combustion engine on the basis of the influence estimated and calculated by the vehicle influence estimation means.

With the engine control unit for internal combustion engines, according to the invention, the plurality of combustion systems include a first combustion system being low in combustion stability but excellent in fuel economy, and a second combustion system being inferior in fuel economy to the first combustion system but high in combustion stability, and the combustion switchover means includes a control condition for switchover of a combustion mode of the internal combustion engine according to an operating state of the internal combustion engine and controls to switch a combustion mode of the internal combustion engine over to the second combustion system on the basis of an influence by the vehicle influence estimation means even when the internal combustion engine is put in an operating state to enable carrying out the first combustion system.

In the engine control unit for internal combustion engines, according to the invention, the condition having an influence on an operation of the vehicle is based on at least one of vehicle peripheral information, traveling geographical information, and vehicle stability information.

The internal combustion engine, to which the engine control unit for internal combustion engines, according to the invention, is applied, is a gasoline engine, the first combustion system comprises compression ignition combustion, and the second combustion system comprises spark ignition combustion and compression ignition combustion.

A vehicle or a hybrid vehicle according to the invention mounts thereon the engine control unit for internal combustion engines described above.

According to the invention, it is possible in, for example, an internal combustion engine (engine), which is mounted on a vehicle, to switch a combustion mode of the engine on the basis of results of detection of an operating condition of the vehicle or on the basis of results of estimation of an influence, which the results of detection have on an operation of the vehicle. By carrying out such switchover of combustion, it becomes possible to carry out not only switchover of combustion according to an operating state of an engine but also switchover of combustion of an engine so as to maintain a combustion mode optimum for an operation of a vehicle, on which the engine is mounted. Thereby, it becomes possible to ensure operational performance and safety performance of a vehicle at the same time while ensuring fuel consumption performance and exhaust performance of an engine.

Other objects, features and advantages of the invention will become apparent from the following description of the embodiments of the invention taken in conjunction with the accompanying drawings.

DETAILED DESCRIPTION OF THE INVENTION

Embodiment 1

Figure 1:
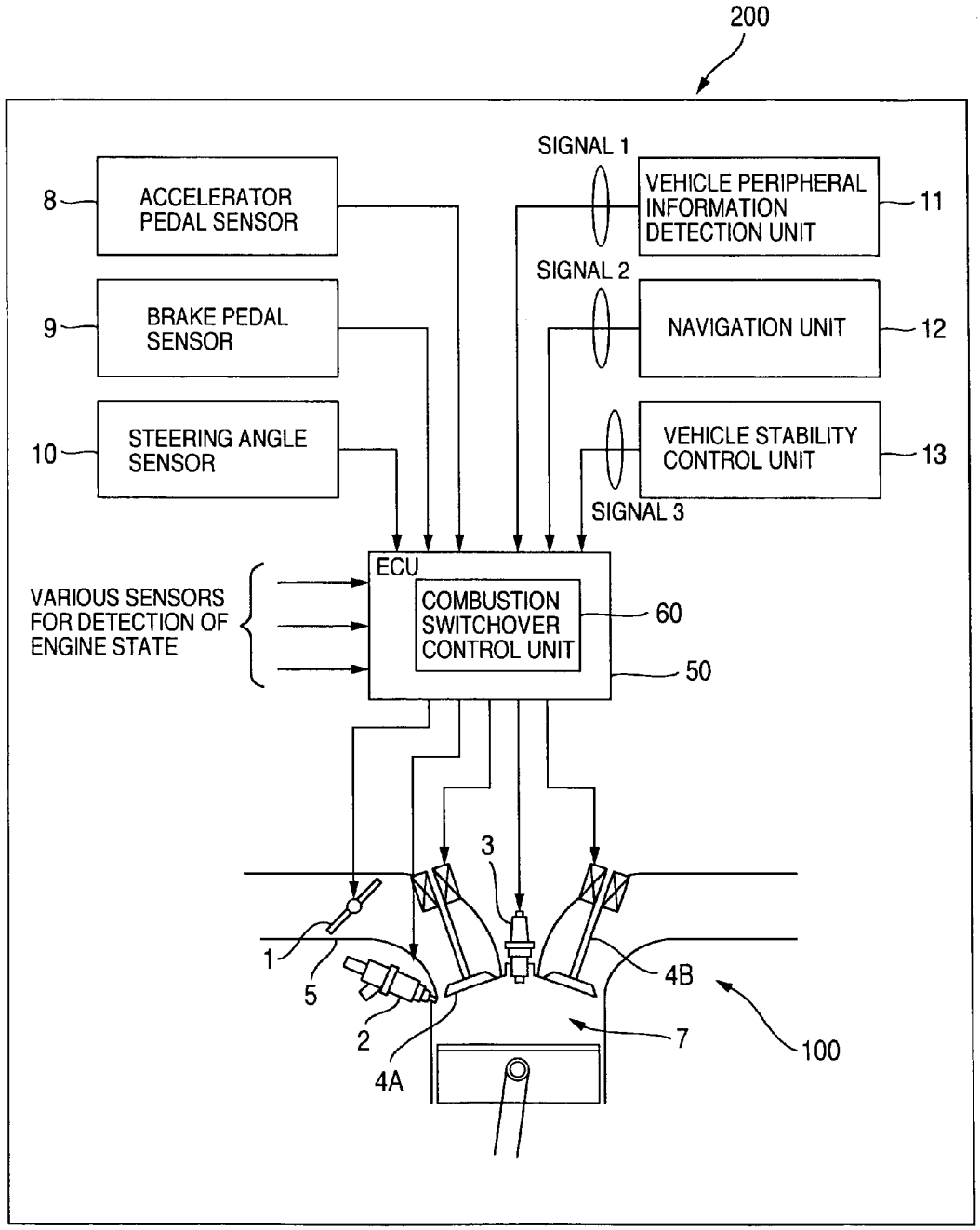
FIG. 1 is a view illustrating a system configuration of Embodiment 1, in which a control unit of a vehicular internal combustion engine according to the invention is applied to a compression ignition gasoline engine, for which two combustion systems, that is, spark ignition combustion and compression ignition combustion are selectively carried out.

Embodiment 1, in which a control unit of a vehicular internal combustion engine according to the invention is applied to a compression ignition gasoline engine, for which two combustion systems, that is, spark ignition combustion (second combustion system) and compression ignition combustion (first combustion system) are selectively carried out, will be described with reference to FIG. 1.

An engine 100 is mounted as a prime mover on a vehicle 200 such as automobiles, or the like, and comprises a throttle valve 1 provided in a suitable position in an intake passage 5 to adjust an intake flow rate. The engine 100 comprises, every cylinder, an injector 2 that jets a fuel directly into a combustion chamber 7, an ignition plug 3 that feeds an ignition energy, and a variable intake valve 4A and a variable exhaust valve 4B, which adjust inlet gases flowing into the combustion chamber 7, exhaust gases discharged from the combustion chamber 7, and an EGR quantity in the combustion chamber 7.

Provided in respective suitable positions on the vehicle 200 mounting thereon the engine 100 are an accelerator pedal sensor 8 that detects an accelerator operation by a driver, a brake pedal sensor 9 that detects a brake operation by a driver, and a steering angle sensor 10 that detects a steering operation by a driver.

Further, provided in respective suitable positions on the vehicle 200 are an engine control unit 50 (referred below to as ECU) that controls the engine 100, a vehicle peripheral information detection unit 11 that detects a distance to an obstacle around the vehicle 200, etc., a navigation unit 12 that acquires positional information of the vehicle 200, etc., and a vehicle stability control unit 13 that ensures stability of an operation of the vehicle 200.

The vehicle peripheral information detection unit 11 comprises a vehicular gap sensor that detects a distance between another vehicle traveling in front of the vehicle 200 and the vehicle 200, or a sensor that detects a distance to an obstacle around the vehicle 200, or a camera sensor that analyzes a picture to measure a distance, the vehicle peripheral information detection unit acting to transmit results (a signal 1) of detection or measurement to the ECU 50.

The navigation unit 12 acquires or deduces positional information of the vehicle by GPS, etc., an altitude or an angle of inclination of a traveling course, and weather information, jam information, etc. around the vehicle 200, from car-mounted information storage means or from outside, the navigation unit transmitting such information (a signal 2) to the ECU 50.

The vehicle stability control unit 13 ensures the traveling stability of the vehicle as by operating a brake mounted on the vehicle 200 and changing a proportion of distribution of a drive force for wheels although not shown, in order to prevent sideslip of the vehicle 200, and demands an engine torque (a signal 3) required for ensuring stability of the vehicle 200 relative to the ECU 50.

The ECU 50 has results of detection in the accelerator pedal sensor 8, the brake pedal sensor 9, the steering angle sensor 10, the vehicle peripheral information detection unit 11, the navigation unit 12, the vehicle stability control unit 13, and various sensors, which are not shown in the figure but arranged in suitable positions on the engine 100 to detect a state of the engine 100, input thereinto to control the throttle valve 1, the injector 2, the ignition plug 3, the variable intake valve 4A, and the variable exhaust valve 4B to control output and engine speed of the engine 100.

Figure 2:
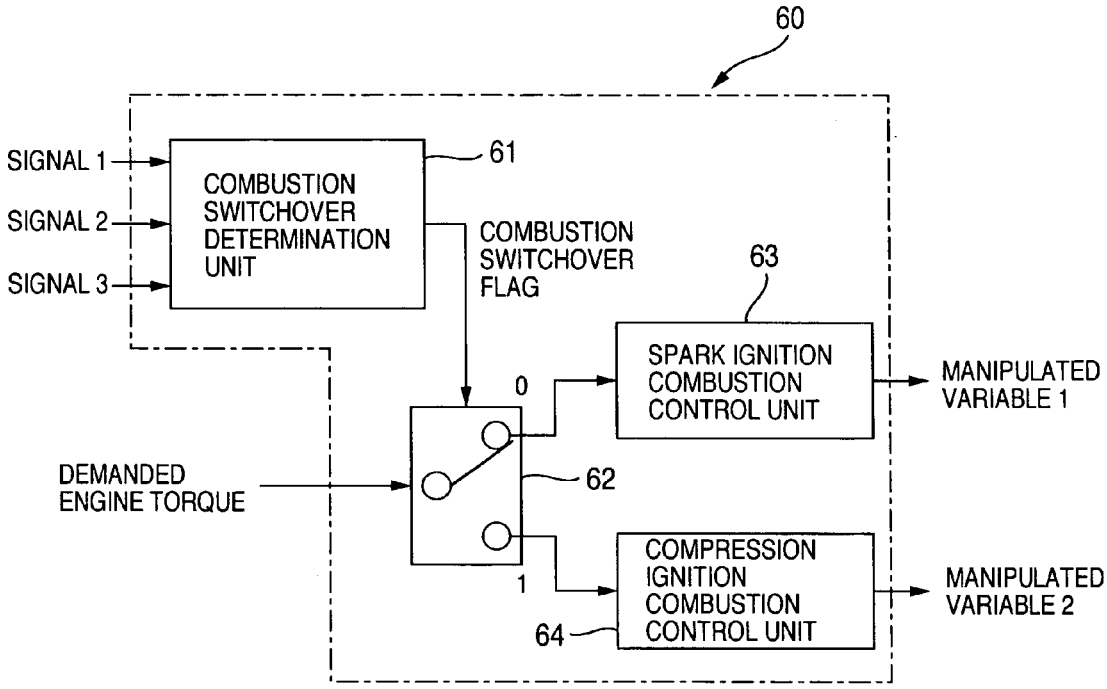
FIG. 2 is a block diagram illustrating an example of a detailed construction of a combustion switchover control unit in Embodiment 1 of the invention.

The ECU 50 is of a microcomputer type to materialize a combustion switchover control unit 60 by means of software processing. The combustion switchover control unit 60 comprises, as shown in FIG. 2, a combustion switchover determination unit 61, a demanded torque switchover unit 62, a spark ignition combustion control unit 63, and a compression ignition combustion control unit 64.

The combustion switchover determination unit 61 has a signal 1 of the vehicle peripheral information detection unit 11, a signal 2 of the navigation unit 12, and a signal 3 of the vehicle stability control unit 13 input thereinto to set a combustion switchover flag ON (=1) or OFF (=0).

Figure 3:
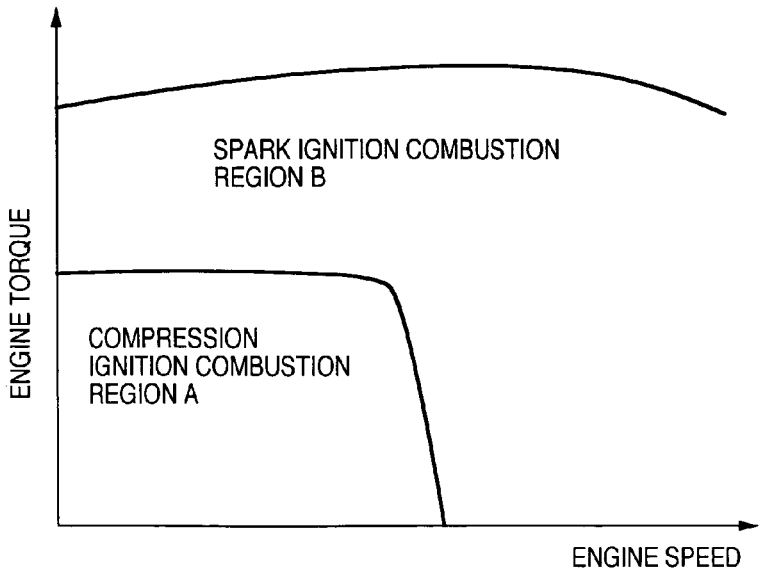
FIG. 3 is a map illustrating regions, in which spark ignition combustion and compression ignition combustion can be carried out.

The combustion switchover determination unit 61 finds a logical product (AND) of the signal 1, the signal 2, and the signal 3 and sets the combustion switchover flag ON assuming that compression ignition combustion control is possible only in the case where all the signals are made ON and it is judged that an operating state stands in a region A, in which compression ignition combustion shown in FIG. 3 and prescribed by engine torque and engine speed is feasible.

In addition, the combustion switchover determination unit 61 may find a logical sum (OR) of the signal 1, the signal 2, and the signal 3 and set the combustion switchover flag ON assuming that compression ignition combustion is feasible in the case where all the signals are made ON.

The signal 1 is an output signal of the vehicle peripheral information detection unit 11 and set ON or OFF. The vehicle peripheral information detection unit 11 sets the signal 1 ON judging that compression ignition combustion is feasible in the case where a vehicular gap between the vehicle 200 and another vehicle, or a surrounding obstacle is equal to or larger than a predetermined value 1. In contrast, in the case where a vehicular gap is equal to or less than a predetermined value 1, acceleration or deceleration is necessary for the vehicle 200 to avoid a danger, so that the signal is set OFF judging that it is necessary to carry out spark ignition combustion, in which an engine output is high in responsibility.

The signal 2 is an output signal of the navigation unit 12 and set ON or OFF. The navigation unit 12 acquires map (geographical) information from outside or car-mounted information storage means to deduce a traveling course of the vehicle 200, and sets the signal 2 ON judging that compression ignition is possible in order to cause the vehicle 200 to mainly carry out steady traveling in the case where it is determined that an altitude or an angle of inclination of a traveling course is equal to or less than a predetermined value 2. Also, in the case where a driver judges that accelerator operation, steering operation, and braking operation are frequently performed in the deduced traveling course, the signal 2 is set OFF expecting that an engine output is frequently varied and judging that it is necessary to carry out spark ignition combustion. Also, an output of the signal 2 may be selected according to weather information acquired from outside, or an output of the signal 2 may be selected according to jam information.

The signal 3 is an output signal of the vehicle stability control unit 13 and set ON or OFF. When demanding an engine torque in order to ensure stability of the vehicle 200, the vehicle stability control unit 13 sets the signal 3, being an output, OFF judging that an engine output is required to be high in responsibility and it is necessary to carry out spark ignition combustion. Also, in the case where the vehicle stability control unit 13 does not demand an engine torque, it is judged that compression ignition combustion control can be exercised and the signal 3 is set ON.

The demanded torque switchover unit 62 inputs a demanded engine torque, which is calculated from accelerator operation by a driver, or the like into the compression ignition combustion control unit 64, in the case where an operating state stands in the region A, in which compression ignition combustion is feasible, and so the combustion switchover flag is made ON, and inputs a demanded engine torque into the spark ignition combustion control unit 63 in the case where an operating state stands in a region B (see FIG. 3) of spark ignition combustion and so the combustion switchover flag is made OFF.

The spark ignition combustion control unit 63 calculates a manipulated variable 1 for realization of a demanded engine torque in spark ignition combustion in the case where it is judged that the engine 100 should be operated to carry out spark ignition combustion.

The compression ignition combustion control unit 64 calculates a manipulated variable 2 for realization of a demanded torque in compression ignition combustion in the case where it is judged that an operating state of the engine 100 makes compression ignition combustion feasible.

The manipulated variable 1 and the manipulated variable 2, respectively, are target values instructed to the throttle valve 1, the injector 2, the ignition plug 3, the variable intake valve 4A, and the variable exhaust valve 4B to enable a demanded engine torque while carrying out spark ignition combustion and compression ignition combustion.

Figure 4:
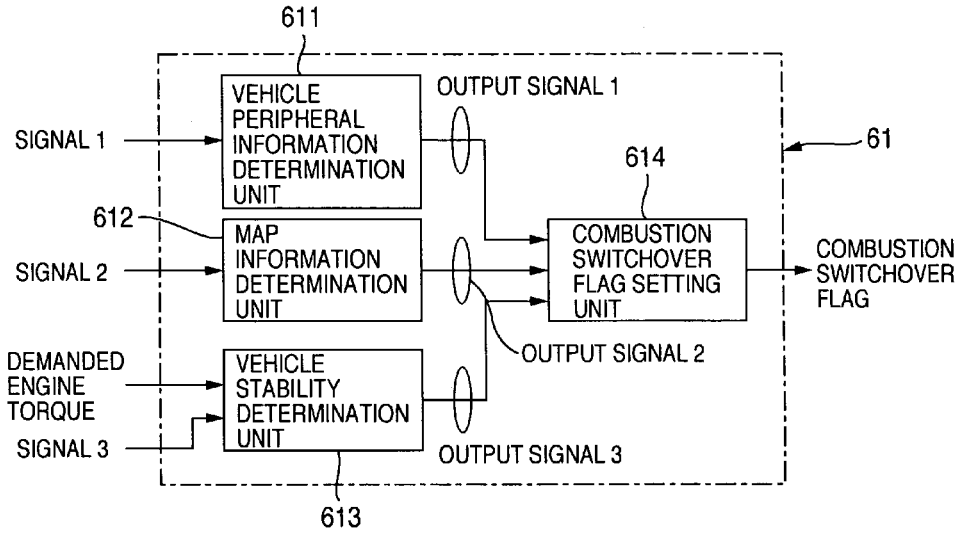
FIG. 4 is a block diagram illustrating an example of a combustion switchover determination unit of a combustion switchover control unit in Embodiment 1.

The combustion switchover determination unit 61 may comprise, as shown in FIG. 4, a vehicle peripheral information determination unit 611, a map information (traveling geographical information) determination unit 612, and a vehicle stability determination unit 613.

The signal 1 output from the vehicle peripheral information detection unit 11 is a signal indicative of a distance of the vehicle 200 from a peripheral article, and the vehicle peripheral information determination unit 611 has the signal 1 input thereinto and sets the output signal 1 ON judging that compression ignition combustion is feasible in the case where a distance indicated by the signal 1 is equal to or larger than the predetermined value 1. In contrast, in the case where a distance indicated by the signal 1 is equal to or less than the predetermined value 1, it is judged that it is necessary to carry out spark ignition combustion and the output signal 1 is set OFF.

The signal 2 output from the navigation unit 12 is a signal indicative of positional information of the vehicle 200, and the map information determination unit 612 has the signal 2 input thereinto to deduce a traveling course of the vehicle 200 within a predetermined value 4, on the basis of positional information indicated by the signal 2, and sets the output signal 2 ON judging that compression ignition combustion is feasible in the case where an altitude or an angle of inclination of a traveling course is equal to or less than the predetermined value 2. In contrast, in the case where an altitude or an angle of inclination of a traveling course is equal to or larger than the predetermined value 2, it is judged that it is necessary to carry out spark ignition combustion and the output signal 2 is set OFF.

In the case where the signal 3 being an output of the vehicle stability control unit 13 is an engine torque required for ensuring stability of the vehicle, the vehicle stability control unit 13 has the signal 3 input thereinto and when an engine torque (demanded engine torque) is demanded in order to ensure stability of the vehicle 200, sets the signal 3 OFF judging that in order to ensure stability of the vehicle 200 when the engine torque is output, it is necessary to carry out spark ignition combustion. In the case where an engine torque is not demanded from the vehicle stability control unit 13, it is judged that compression ignition combustion is feasible, and the output signal 3 is set ON.

A combustion switchover flag setting unit 614 sets a combustion switchover flag on the basis of the output signal 1, the output signal 2, and the output signal 3.

In the case where, for example, a logical sum (OR) of the output signal 1, the output signal 2, and the output signal 3 is found and one of the output signals is made ON, a combustion switchover flag may be set ON assuming that compression ignition combustion is feasible.

Also, only in the case where a logical product (AND) of the output signals is found and all the output signals are made ON, a combustion switchover flag may be set ON assuming that compression ignition combustion control can be exercised.

Figure 5:
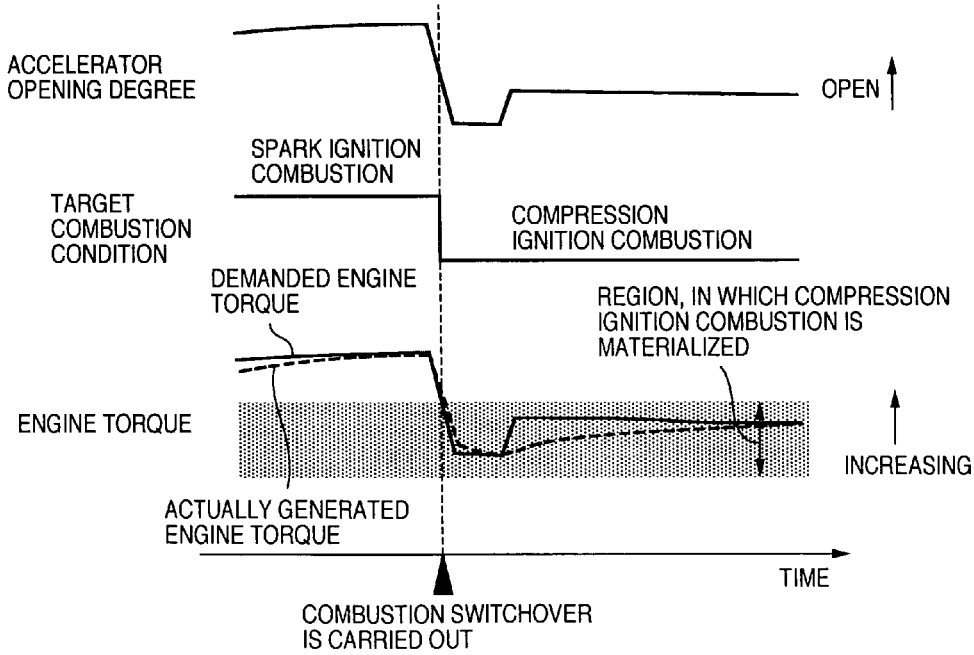
FIG. 5 is a time chart illustrating accelerator opening degree, target combustion condition, and engine torque when the related art is applied.
Figure 6:
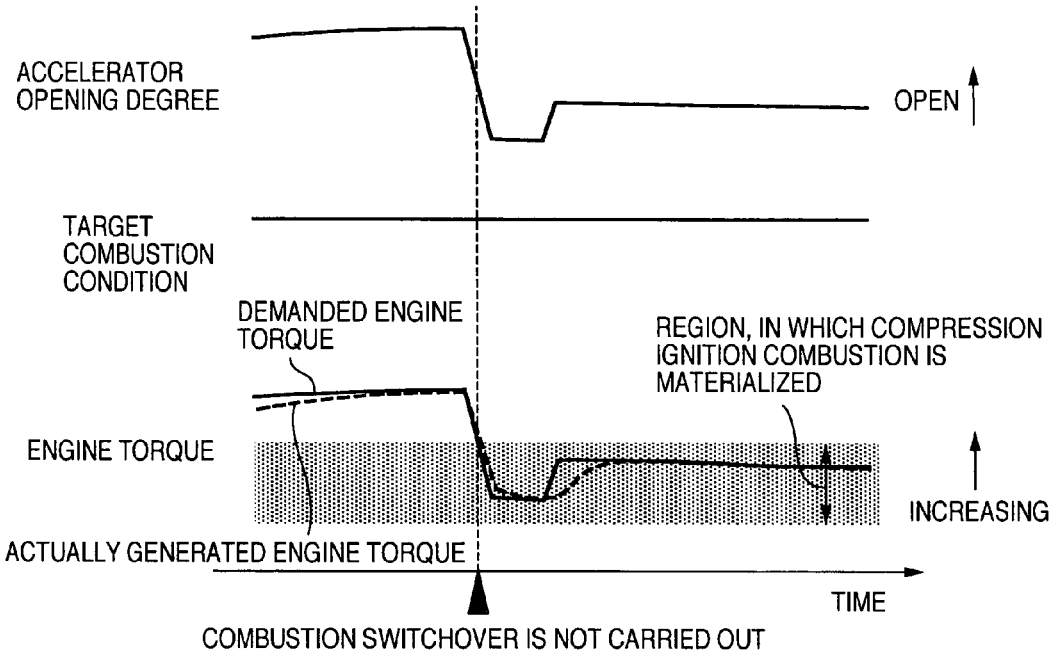
FIG. 6 is a time chart illustrating accelerator opening degree, target combustion condition, and engine torque when Embodiment 1 of the invention is applied.

FIG. 5 shows time series of accelerator opening degree, target combustion condition, and engine torque in the case where the related art is applied to a compression ignition engine. FIG. 6 shows time series of accelerator opening degree, target combustion condition, and engine torque in the case where the embodiment of the invention is applied to a compression ignition engine.

As accelerator opening degree and engine torque go upward in the figures, it is indicated that accelerator opening degree becomes large and engine torque increases, and for target combustion condition, spark ignition combustion is shown in an upper region in the figures and compression ignition combustion is shown in a lower region. In FIGS. 5 and 6, however, a land area is supposed, in which vehicles are frequently accelerated.

With the related art shown in FIG. 5, by carrying out spark ignition combustion in the case where accelerator opening degree is large, a demanded engine torque and an actually generated engine torque are caused to substantially agree with each other, but when a demanded engine torque comes within a region, in which compression ignition combustion is feasible, compression ignition combustion is carried out, so that in compression ignition combustion, in which an engine torque is low in responsibility, it takes time until a demanded engine torque and an actually generated engine torque agree with each other. Thereby, the vehicle is decreased in operational performance.

In contrast, with Embodiment 1 of the invention shown in FIG. 6, since a land area is determined by the navigation unit to be one, in which vehicles are frequently accelerated, spark ignition combustion is continued even when a demanded engine torque is within a region, in which compression ignition combustion is feasible, so that it is possible to make a demanded engine torque and an actually generated engine torque substantially agree with each other. Thereby, the vehicle is increased in operational performance.

Figure 7:
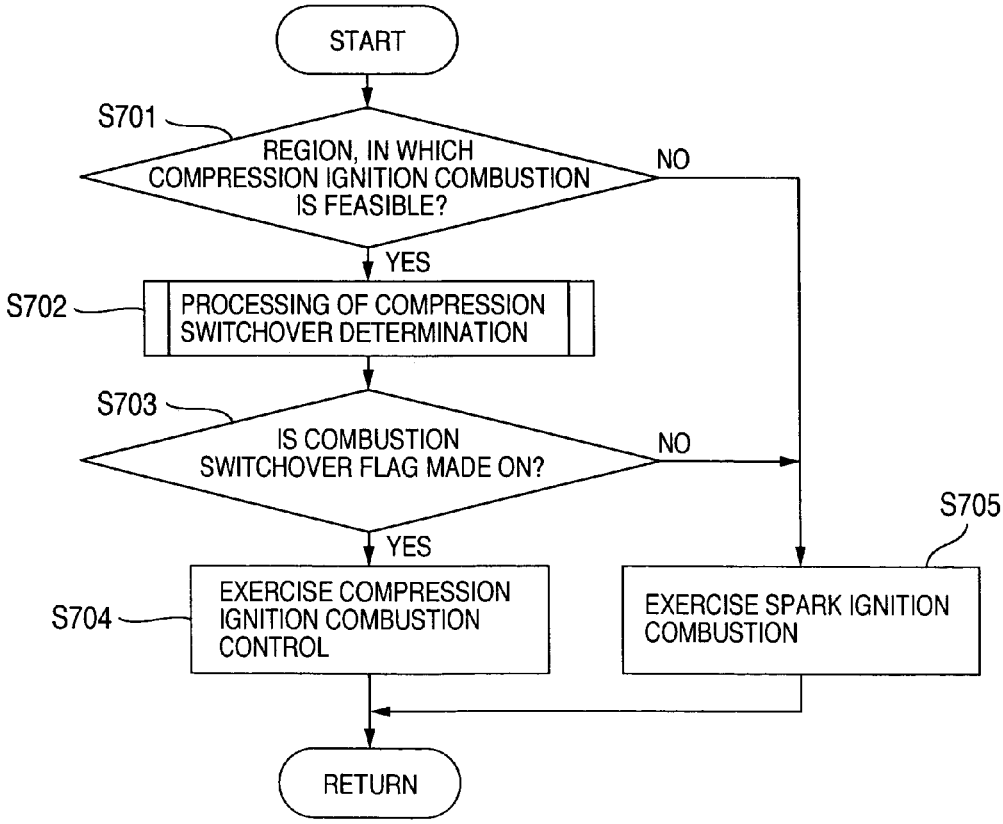
FIG. 7 is a flowchart illustrating a processing flow of combustion switchover control in Embodiment 1 of the invention.

Subsequently, a processing flow of combustion switchover control of the combustion switchover control unit 60 will be described with reference to a flowchart in FIG. 7.

First, it is judged on the basis of the map shown in FIG. 3 whether an operating state of the engine 100 is within a region, in which compression ignition combustion can be materialized (STEP S701). In the case where it is impossible to carry out compression ignition combustion, a processing of exercising spark ignition combustion control is carried out (STEP S705), and a series of processings is terminated.

In contrast, in the case where compression ignition combustion is feasible, a processing of compression switchover determination is carried out and a combustion switchover flag is set ON or OFF (STEP S702).

Subsequently, it is determined whether a combustion switchover flag is made ON (STEP S703). In the case where a combustion switchover flag is made ON, compression ignition combustion control is exercised (STEP S704), and a series of processings is terminated.

Subsequently, details of the processing of compression switchover determination (STEP S702) will be described with reference to a flowchart in FIG. 8.

First, it is determined whether the signal 3 being an output signal of the vehicle stability control unit 13 is made ON (STEP S801). In the case where the signal 3 is made OFF, it is subsequently determined whether the signal 2 being an output signal of the navigation unit 12 is made ON (STEP S803). In the case where the signal 2 is made OFF, it is subsequently determined whether the signal 1 being an output signal of the vehicle peripheral information detection unit 11 is made ON (STEP S804). In the case where the signal 1 is made OFF, a combustion switchover flag is set OFF (STEP S802) determining that it is necessary to carry out spark ignition combustion, and a series of processings is terminated.

In contrast, in the case where one of the signals 1, 2, and 3 is made ON, a combustion switchover flag is set ON (STEP S802). That is, in the case, where a logical sum (OR) of the signals 1, 2, and 3 is found and one of the signals is made ON, a combustion switchover flag is set ON assuming that compression ignition combustion is feasible, and a series of processings is terminated.

Figure 8:
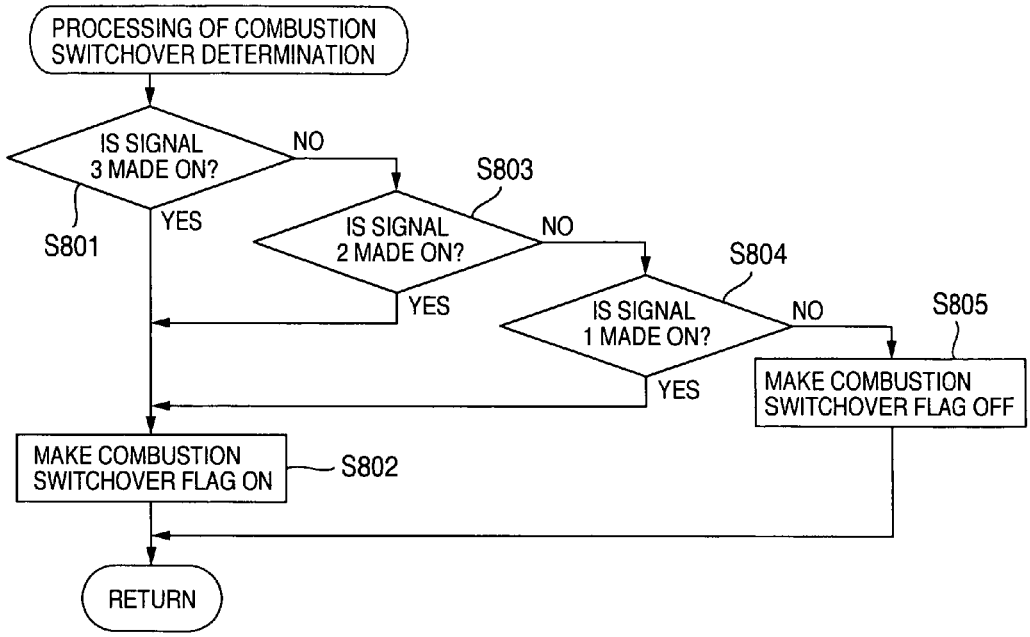
FIG. 8 is a flowchart illustrating an example of a processing flow of compression switchover determination in combustion switchover control in Embodiment 1 of the invention.

In addition, in the flowchart in FIG. 8, while a combustion switchover flag is set ON finding a logical sum (OR) of the signal 1, the signal 2, and the signal 3, a combustion switchover flag may be set ON finding a logical product (AND) of the signal 1, the signal 2, and the signal 3 according to the performance of compression ignition combustion, demanded specifications, etc.

Figure 9:
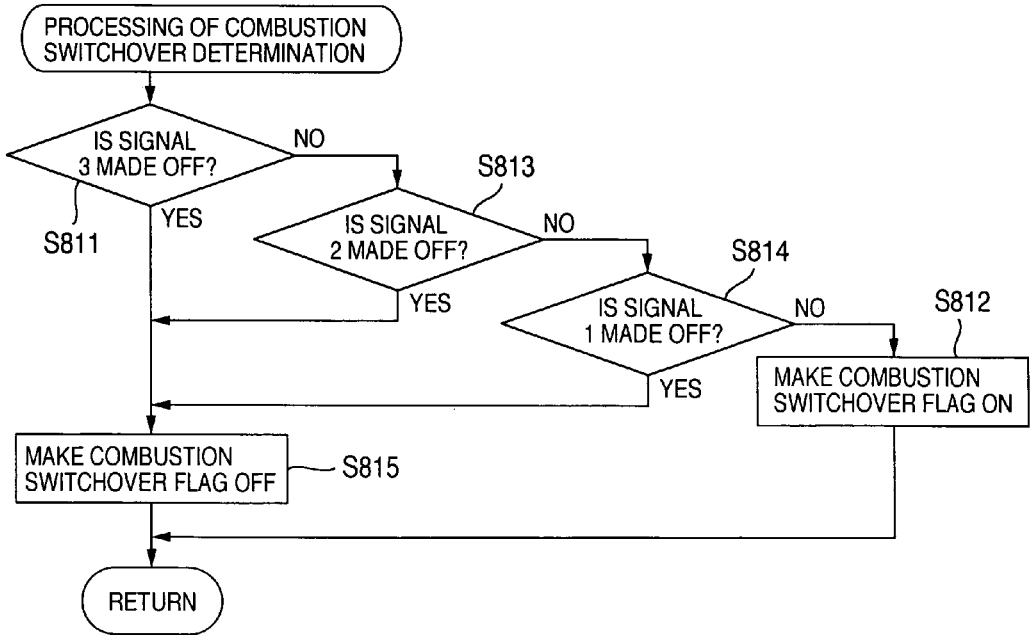
FIG. 9 is a flowchart illustrating another example of a processing flow of compression switchover determination in combustion switchover control in Embodiment 1 of the invention.

FIG. 9 illustrates a processing flow in this case. First, it is determined whether the signal 3 being an output signal of the vehicle stability control unit 13 is made OFF (STEP S811). In the case where the signal 3 is made ON, it is determined whether the signal 2 being an output signal of the navigation unit 12 is made OFF (STEP S813). In the case where the signal 2 is made ON, it is subsequently determined whether the signal 1 being an output signal of the vehicle peripheral information detection unit 11 is made OFF (STEP S814). In the case where the signal 1 is made ON, that is, all the signal 1, the signal 2, and the signal 3 are made ON, a combustion switchover flag is set ON (STEP S812).

In contrast, in the case where one of the signals 1, 2, and 3 is made OFF, a combustion switchover flag is set OFF (STEP S815).

By applying Embodiment 1, an appropriate combustion switchover conformed to a traveling state of the vehicle, which includes a traveling environment, is made feasible, so that it is possible to achieve an improvement in operational performance and safety performance of the vehicle.

Embodiment 2

Figure 10:
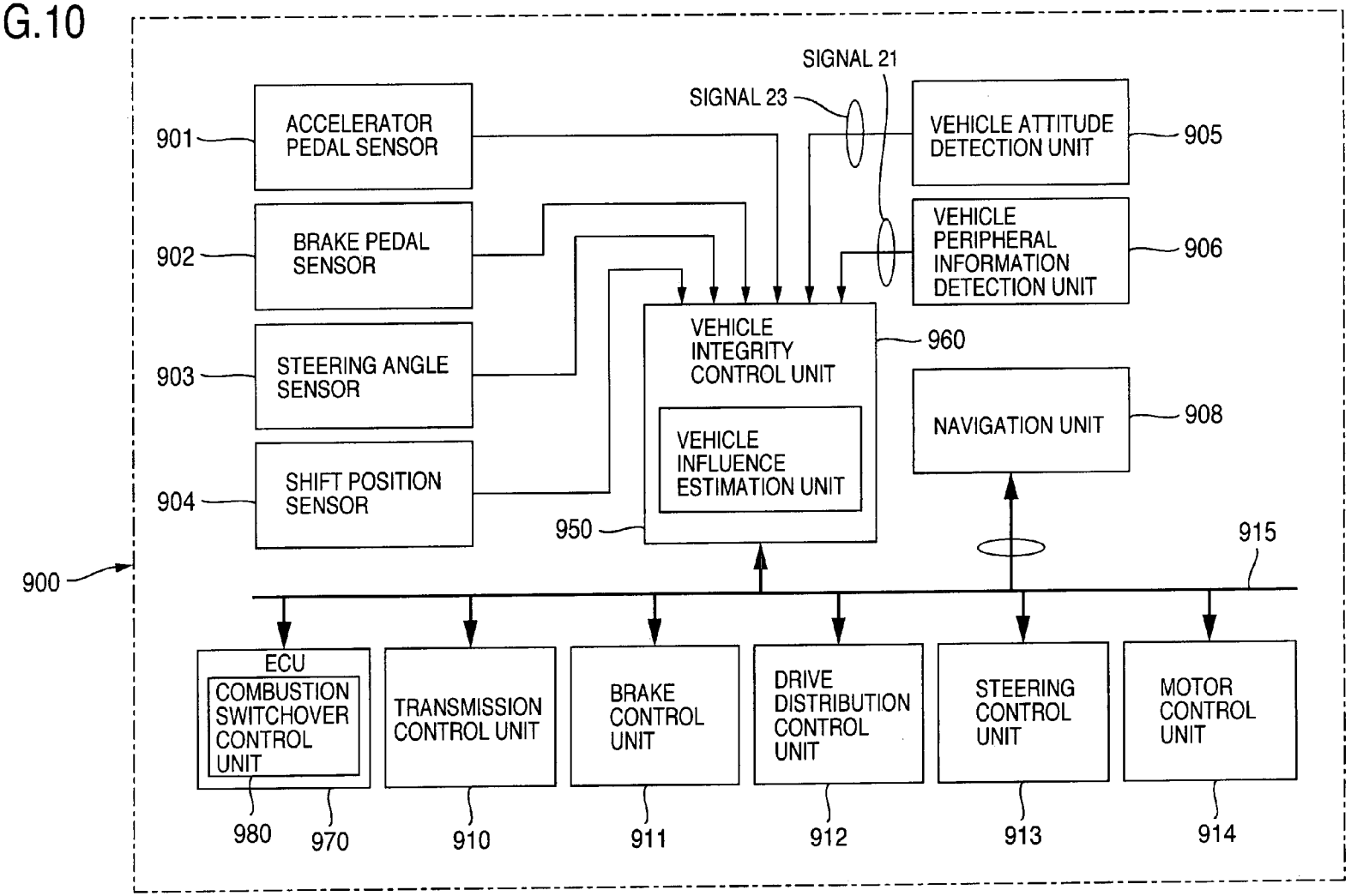
FIG. 10 is a view illustrating a system configuration of Embodiment 2, in which a control unit of a vehicular internal combustion engine according to the invention is applied to a compression ignition gasoline engine, for which two combustion systems, that is, spark ignition combustion and compression ignition combustion are selectively carried out.

Embodiment 2, in which a control unit of a vehicular internal combustion engine according to the invention is applied to a compression ignition gasoline engine, for which two combustion systems, that is, spark ignition combustion and compression ignition combustion are selectively carried out, will be described with reference to FIG. 10. A vehicle according to the embodiment is a hybrid vehicle comprising an internal combustion engine and an electric motor as a prime mover.

In order to detect a driver's demand on a vehicle, a vehicle 900 comprises, in respective suitable positions, an accelerator pedal sensor 901, a brake pedal sensor 902, a steering angle sensor 903, and a shift position sensor 904.

The vehicle 900 further comprises, in respective suitable positions, a vehicle attitude detection unit 905 that detects a state of an attitude of the vehicle 900, and a vehicle peripheral information detection unit 906 that detects a peripheral condition around the vehicle 200.

Further, the vehicle 900 comprises a vehicle integrity control unit 950 that integrally controls an operation of the vehicle 900, a navigation unit 908 that acquires positional information of the vehicle 900, etc., an ECU 970 that controls an engine, a transmission control unit 910 that controls a transmission, a brake control unit 911 that controls a brake, a drive distribution control unit 912 that controls distribution of a drive force for wheels, a steering control unit 913 that controls a steering angle of wheels, and a motor control unit 914 that controls a motor for supplying of a drive force to the vehicle.

The vehicle integrity control unit 950, the navigation unit 908, the ECU 970, the transmission control unit 910, the brake control unit 911, the drive distribution control unit 912, the steering control unit 913, and the motor control unit 914 are connected to enable two-way communication through a communication cable 915 by means of CAN, etc. to give and receive information.

While not clearly shown in the figure, an engine, a transmission, a brake, a drive distribution unit, a steering unit, and a motor, which are respectively controlled by the ECU 970, the transmission control unit 910, the brake control unit 911, the drive distribution control unit 912, the steering control unit 913, and the motor control unit 914, are provided in suitable positions on the vehicle 900.

Figure 11:
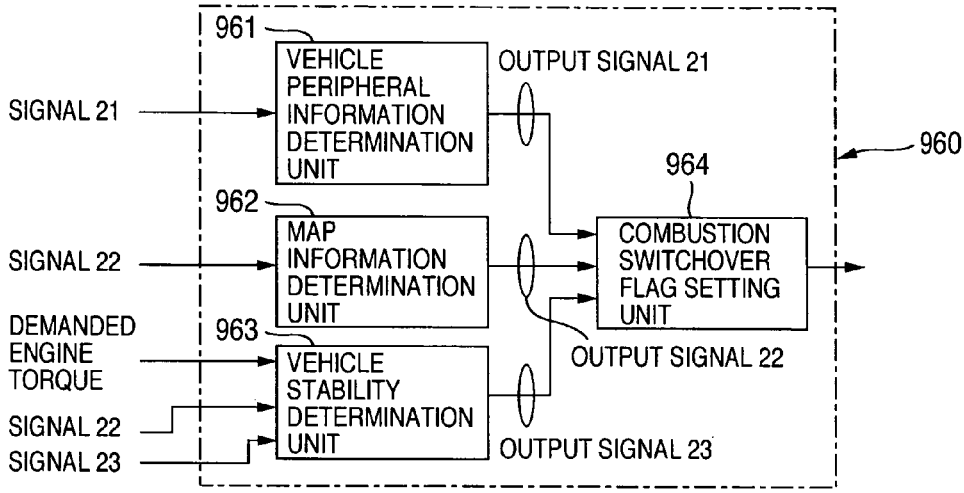
FIG. 11 is a block diagram illustrating an example of a detailed construction of a vehicle influence estimation unit in Embodiment 2 of the invention.

The vehicle integrity control unit 950 comprises a vehicle influence estimation unit 960. The vehicle influence estimation unit 960 comprises, as shown in FIG. 11, a vehicle peripheral information determination unit 961, a navigation information determination unit 962, a vehicle stability determination unit 963, and a combustion switchover flag setting unit 964.

The vehicle peripheral information determination unit 961 calculates an output signal 21 on the basis of a signal 21 being an output signal of the vehicle peripheral information detection unit 906.

The vehicle peripheral information detection unit 906 may comprise a vehicular gap sensor that measures a distance between another vehicle traveling in front of the vehicle 900 and the vehicle 900, or a distance sensor that detects a distance to an obstacle around the vehicle 900, or a camera that measures a situation around the vehicle 900 by means of a picture, the vehicle peripheral information detection unit measuring a distance between the vehicle 900 and an obstacle therearound to output the same as a signal 21.

The vehicle peripheral information determination unit 961 makes a comparison between the signal 21 and a certain predetermined value 21, and when the signal 21 is equal to or larger than the predetermined value 21, sets the output signal 21 ON (=1) judging that compression ignition combustion is feasible. In contrast, in the case where the signal 21 is equal to or less than the predetermined value 21, the vehicle peripheral information determination unit judges that compression ignition combustion is not feasible, and sets the output signal 21 OFF (=0). Also, making a judgment on the basis of a predetermined value 21A being larger than the predetermined value 21, the output signal 21 may be made OFF in the case where it is estimated that a vehicular gap becomes equal to or less than the predetermined value 21A, that is, the predetermined value 21.

The navigation information determination unit 962 calculates an output signal 22 on the basis of a signal 22 being an output signal of the navigation unit 908.

The navigation unit 908 calculates or deduces a traveling course, a road surface condition, and a jam condition on the basis of map (geographical) information to output the same as a signal 22.

In the case where the signal 22 is traveling course information, and in the case where an altitude or an angle of inclination of a traveling course is equal to or larger than the predetermined value 22, or estimated to become equal to or larger-than the predetermined value 22 in a predetermined period of time, the navigation information determination unit 962 judges that a high output is demanded of an engine, or an engine is demanded of an output being high in responsibility and sets the signal 22 OFF assuming that it is impossible for an engine to carry out compression ignition combustion and it is necessary to carry out spark ignition combustion. In contrast, in the case where an altitude or an angle of inclination of a traveling course is equal to or less than the predetermined value 22, the signal 22 is set ON judging that compression ignition combustion is feasible.

Also, the navigation information (traveling geographical information) determination unit 962 makes a judgment using a predetermined value 22A, which is less than the predetermined value 22, and may set the output signal 22 OFF in the case where it is judged that an altitude or an angle of inclination of a traveling course is equal to or larger than the predetermined value 22A, that is, the predetermined value 22. Also, in the case where the signal 22 includes jam information, the output signal 22 may be made ON in order to preferentially carry out compression ignition combustion according to the jam condition and a traveling state of the vehicle 900 with a view to reduction in fuel consumption.

The vehicle stability determination unit 963 calculates an output signal 23 on the basis of a signal 22 being an output of the navigation unit 908, a signal 23 being an output of the vehicle attitude detection unit 905, and a demanded engine torque 2. The vehicle attitude detection unit 905 is a gyro-sensor or the like, which is capable of detecting roll, pitch, and yaw of the vehicle 900, and outputs attitude information of the vehicle 900 as a signal 23.

The vehicle stability determination unit 963 judges whether the vehicle 900 can travel stably in a present traveling state (demanded engine torque 2), on the basis of an angle of inclination of and a curvature of a curve of a traveling course included in the signal 22, attitude information of the vehicle included in the signal 23, and a traveling state of the vehicle 900, and sets the output signal 23 ON judging that compression ignition combustion is feasible, in the case where it is determined that the vehicle can travel stably. In contrast, in the case where it is judged that the vehicle 900 cannot travel stably, the output signal 23 is set OFF judging that spark ignition combustion is necessary in order to ensure an engine output, which ensures stability for the vehicle 900, by means of an engine, a brake, a transmission, and a unit that controls distribution of a drive force.

Also, in the case where the vehicle stability determination unit 963 comprises a vehicle model, the output signal 23 may be made OFF using the vehicle model in the case where an operating condition difference being a difference between a demanded operating state being an operating state of the vehicle 900 demanded by a driver and an actual operating state calculated or deduced from sensors, etc. is equal to or larger than the predetermined value 23. In another example, a judgment may be made using a predetermined value 23A, which is less than the predetermined value 23, and the predetermined value 23 may be made OFF in the case where it is estimated that the operating condition difference becomes equal to or larger than the predetermined value 23A, that is, the predetermined value 23.

The combustion switchover flag setting unit 964 sets a combustion switchover flag on the basis of the output signal 21, the output signal 22, and the output signal 23. In the case where, for example, a logical product (AND) of the output signal 1, the output signal 2, and the output signal 3 is found and it is beforehand judged that an operating state stands in a region A (an operating region prescribed by engine torque and engine speed, see FIG. 3), in which compression ignition combustion is feasible, a combustion switchover flag is set ON. In contrast, in the case where one of the output signal 21, the output signal 22, and the output signal 23 is made OFF, or it is judged that compression ignition combustion (an operating state stands in a region A, in which compression ignition combustion is feasible,=a region B, in which spark ignition combustion is feasible) is not feasible, a combustion switchover flag is set OFF.

Figure 12:
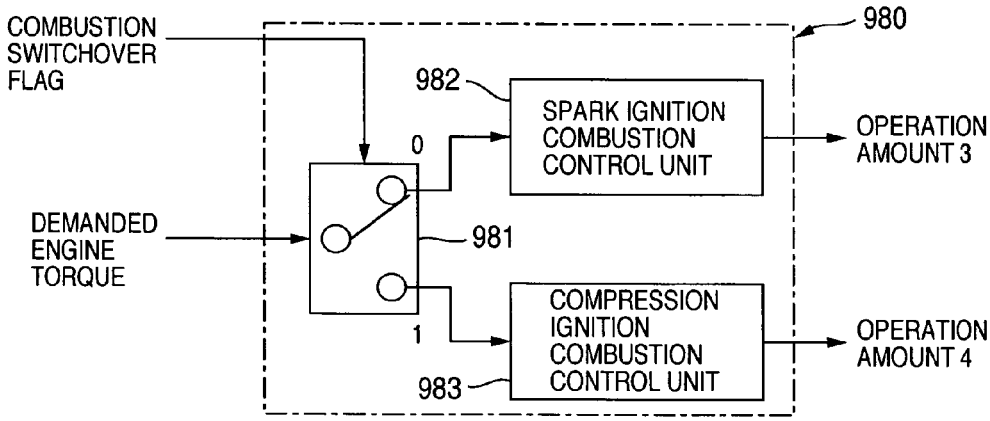
FIG. 12 is a block diagram illustrating an example of a detailed construction of a combustion switchover control unit in Embodiment 2 of the invention.

The ECU 970 comprises a combustion switchover control unit 980. The combustion switchover control unit 980 comprises, as shown in FIG. 12, a demanded torque switchover unit 981, a spark ignition combustion control unit 982, and a compression ignition combustion control unit 983.

The demanded torque switchover unit 981 has a combustion switchover flag input thereinto from the combustion switchover flag setting unit 964 of the vehicle influence estimation unit 960 of the vehicle integrity control unit 950. The demanded torque switchover unit 981 inputs a demanded engine torque into the spark ignition combustion control unit 982 in the case where a combustion switchover flag from the combustion switchover flag setting unit 964 is made OFF (=0), and inputs a demanded engine torque into the compression ignition combustion control unit 983 in the case where a combustion switchover flag is made ON (=1).

The spark ignition combustion control unit 982 calculates a manipulated variable 3, which realizes a demanded engine torque in spark ignition combustion, on the basis of a demanded engine torque.

The compression ignition combustion control unit 983 calculates a manipulated variable 4, which carries out compression ignition combustion to realize a demanded engine torque, on the basis of a demanded engine torque.

Here, while not clearly shown in the figure, a manipulated variable is a signal instructed to an injector that jets a fuel into a cylinder, a throttle valve that adjusts an air quantity flowing into a cylinder, a variable valve that adjusts an air quantity and a displacement volume in a cylinder, an ignition plug that ignites a mixture in a cylinder, etc.

When a combustion switchover flag is made OFF in the case where an engine carries out compression ignition combustion, compression ignition combustion is stopped and quickly changed over to spark ignition combustion.

Also, in the case where spark ignition combustion is being carried out, compression ignition combustion is carried out when it is judged in the map shown in FIG. 3 that compression ignition combustion is feasible and a combustion switchover flag is made ON. Also, in the case where spark ignition combustion is being carried out, spark ignition combustion is continued when it is judged in the map shown in FIG. 3 that compression ignition combustion is not feasible.

Time series of accelerator opening degree, target combustion condition, and engine torque is the same as that in Embodiment 1, and when the related art is applied, it is impossible to realize a target engine torque as shown in FIG. 5 while when Embodiment 2 is applied, it is possible to carry out a target engine torque as shown in FIG. 6.

Figure 13:
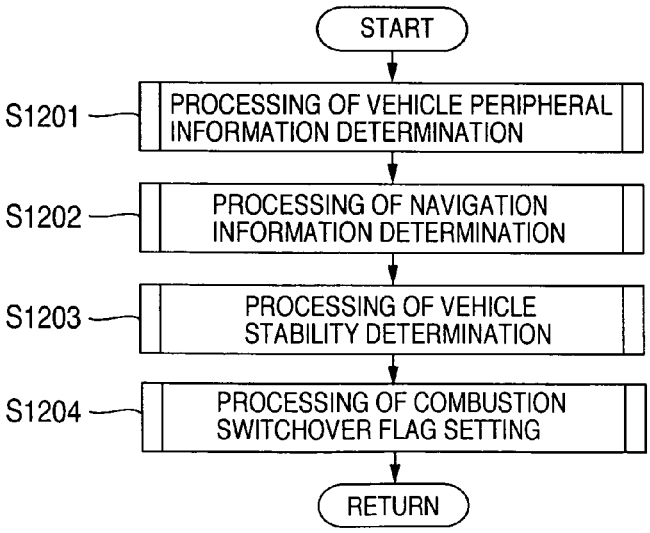
FIG. 13 is a flowchart illustrating a processing flow of a vehicle influence estimation unit in Embodiment 2 of the invention.

Subsequently, a processing flow of the vehicle influence estimation unit 960 will be described with reference to a flowchart shown in FIG. 13.

First, a processing of vehicle peripheral signal determination is carried out and an output signal 21 is set on the basis of a signal 21 (STEP S1201).

Subsequently, a processing of navigation information determination is carried out and an output signal 22 is set on the basis of a signal 22 (STEP S1202).

Subsequently, a processing of vehicle stability determination is carried out and an output signal 23 is set on the basis of a signal 23 (STEP S1203).

Subsequently, a combustion switchover flag is set as a processing of combustion switchover flag setting on the basis of the output signal 21, the output signal 22, and the output signal 23 (STEP S1204), and a series of operations is terminated.

Figure 14:
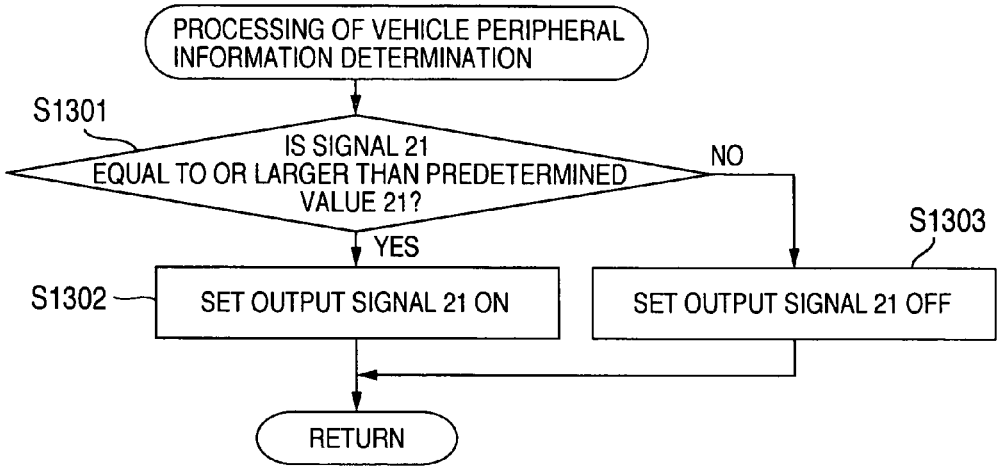
FIG. 14 is a flowchart illustrating the processing of vehicle peripheral information determination in Embodiment 2 of the invention.

Details of the processing of vehicle peripheral information determination (STEP S1201) will be described with reference to a flowchart shown in FIG. 14.

First, it is determined whether the signal 21 is equal to or larger than the predetermined value 21 (STEP S1301).

In the case where the signal 21 is equal to or larger than the predetermined value 21, compression ignition combustion is determined to be feasible with the result that the output signal 21 is set ON (STEP S1302) and a series of operations is terminated.

In contrast, in the case where the signal 21 is equal to or less than the predetermined value 21, it is determined that it is necessary to carry out spark ignition combustion with the result that the output signal 21 is set OFF (STEP S1303) and a series of operations is terminated.

Figure 15:
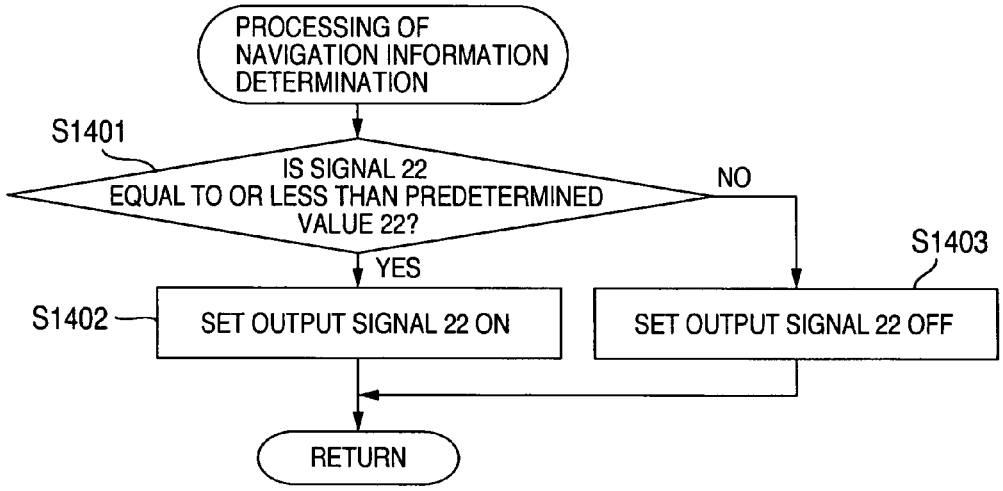
FIG. 15 is a flowchart illustrating the processing of navigation information determination in Embodiment 2 of the invention.

Details of the processing of navigation information determination (STEP S1202) will be described with reference to a flowchart shown in FIG. 15.

First, it is determined whether the signal 22 is equal to or less than the predetermined value 22 (STEP S1401).

In the case where the signal 22 is equal to or less than the predetermined value 22, compression ignition combustion is determined to be feasible with the result that the output signal 22 is set ON (STEP S1401) and a series of operations is terminated.

In contrast, in the case where the signal 22 is equal to or larger than the predetermined value 22, it is determined that it is necessary to carry out spark ignition combustion with the result that the output signal 22 is set OFF (STEP S1403) and a series of operations is terminated.

Figure 16:
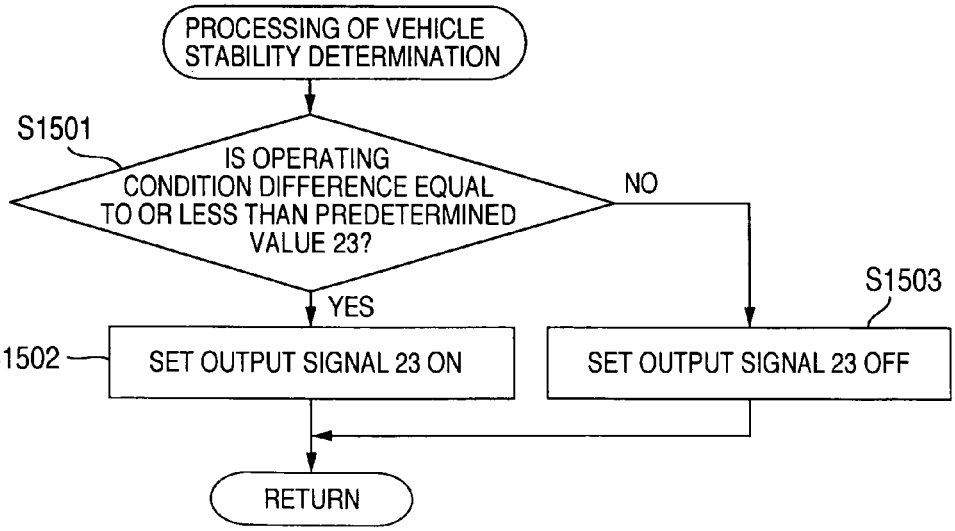
FIG. 16 is a flowchart illustrating the processing of vehicle stability determination in Embodiment 2 of the invention.

Details of the processing of vehicle stability determination (STEP S1203) will be described with reference to a flowchart shown in FIG. 16.

First, it is determined using the vehicle model whether an operating condition difference being a difference between a demanded operating state being an operating state of the vehicle 900 demanded by a driver and an actual operating state calculated or deduced from sensors, etc. is equal to or less than the predetermined value 23 (STEP S1501).

In case of being equal to or less than the predetermined value 23, compression ignition combustion is determined to be feasible with the result that the output signal 23 is set ON (STEP S1502) and a series of operations is terminated.

In contrast, in the case where the signal 23 is equal to or larger than the predetermined value 23, it is determined that it is necessary to carry out spark ignition combustion with the result that the output signal 23 is set OFF (STEP S1503) and a series of operations is terminated.

Details of the processing of combustion switchover flag setting (STEP S1204) will be described with reference to a flowchart shown in FIG. 17.

First, it is determined whether the output signal 23 in the processing of vehicle stability determination is made ON (STEP S1601). In the case where the output signal 23 is made OFF, it is subsequently determined whether the output signal 22 of the processing of navigation information determination is made ON (STEP S1603). In the case where the output signal 22 is made ON, it is subsequently determined whether the output signal 21 of the processing of vehicle peripheral information determination is made ON (STEP S1604). When the output signal 21 is made OFF, a combustion switchover flag is set OFF (STEP S1605) determining that it is necessary to carry out spark ignition combustion and a series of operations is terminated.

In contrast, when one of the output signals 21, 22, and 23 is made ON, a combustion switchover flag is set ON (STEP S1602). That is, when a logical sum (OR) of the output signal 1, the output signal 2, and the output signal 3 is found and one of the signals is made ON, a combustion switchover flag is set ON assuming that compression ignition combustion is feasible, and a series of processings is terminated.

Figure 17:
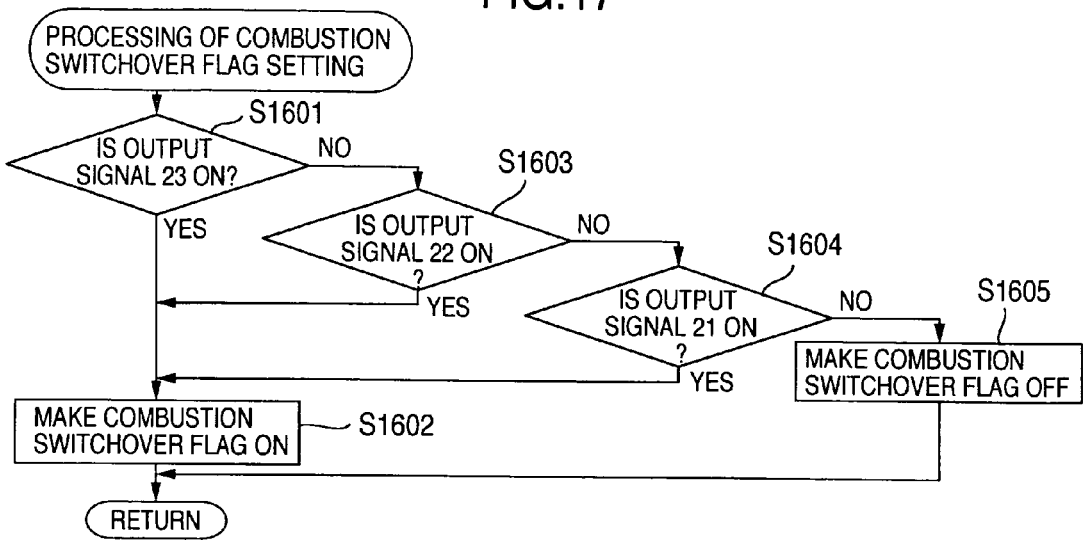
FIG. 17 is a flowchart illustrating an example of the processing of combustion switchover flag setting in Embodiment 2 of the invention.
Figure 18:
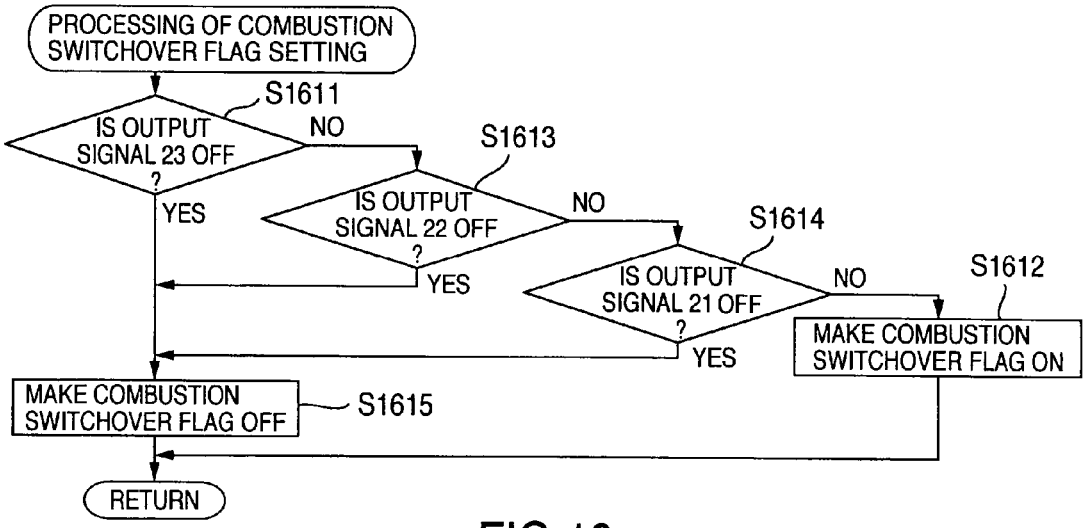
FIG. 18 is a flowchart illustrating another example of the processing of combustion switchover flag setting in Embodiment 2 of the invention.

While a logical sum (OR) of the output signal 1, the output signal 2, and the output signal 3 is found and a combustion switchover flag is set ON in the flowchart shown in FIG. 17 and described above, a combustion switchover flag may be set ON in the embodiment finding a logical product (AND) of the signal 1, the signal 2, and the signal 3 according to the performance of compression ignition combustion, demanded specifications, etc.

Figure 19:
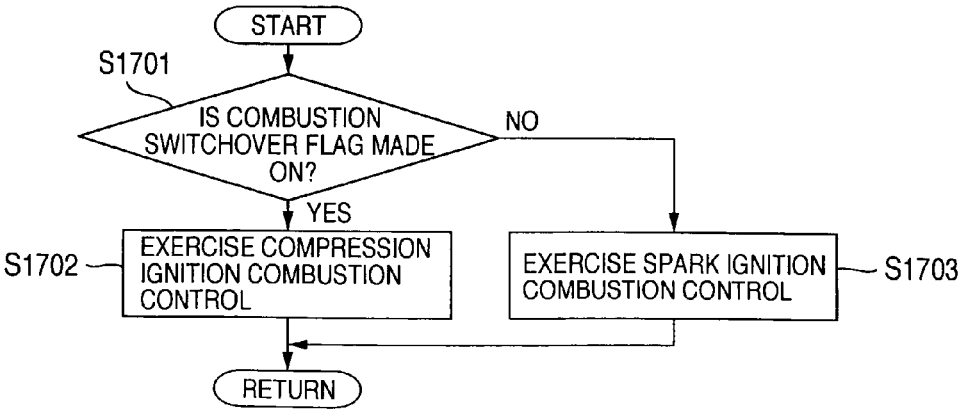
FIG. 19 is a flowchart illustrating a processing flow in the combustion switchover control unit in Embodiment 2 of the invention.

FIG. 19 illustrates a processing flow in this case. First, it is determined whether the output signal 23 in the processing of vehicle stability control is made OFF (STEP S1611). In the case where the output signal 23 is made ON, it is determined whether the output signal 22 of the processing of navigation information determination is made OFF (STEP S1613). In the case where the output signal 23 is made ON, it is subsequently determined whether the output signal 21 of the processing of vehicle peripheral information determination is made ON (STEP S814). In the case where the output signal 21 is made ON, that is, all the output signal 21, the output signal 22, and the output signal 23 are made ON, a combustion switchover flag is set ON (STEP S1612).

In contrast, when one of the output signals 21, 22, and 23 is made OFF, a combustion switchover flag is set OFF (STEP S815).

Subsequently, a processing flow of the vehicle influence estimation unit 960 will be described with reference to the flowchart shown in FIG. 19.

First, it is determined whether a combustion switchover flag is made ON (STEP S1701). In the case where a combustion switchover flag is made ON, control of compression ignition combustion is exercised (STEP S1702), and a series of processings is terminated. In contrast, in the case where a combustion switchover flag is made OFF, control of spark ignition combustion is exercised (STEP S1703), and a series of processings is terminated.

As described above, it is possible according to Embodiment 2 to perform combustion switchover according to a traveling condition of the vehicle 900, so that it is possible to achieve an improvement in operational performance and safety performance of the vehicle 900 as compared with the related art.

According to a further embodiment, the combustion switchover flag setting unit 964 provided in the vehicle influence estimation unit 960 may be provided in the combustion switchover control unit 980 provided in the ECU 970. Also, setting of a combustion switchover flag may be performed on the basis of not only vehicle peripheral information, navigation information, and vehicle attitude information but also all information acquired inside and outside the engine control unit. A combustion switchover flag may be set on the basis of results of diagnosis of the engine made by the ECU 970 and results of diagnosis made by other units than the ECU 970.

Further, the control unit is made the same in construction also in the case where an engine mounted on the vehicle 900 comprises an in-cylinder injection engine to carry out only spark ignition combustion, and spark ignition stratified combustion and spark ignition stratified combustion are carried out in combustion modes. Also, the control unit is made the same in construction in the case where an engine mounted on the vehicle 900 comprises a diesel engine to carry out compression ignition combustion, and compression ignition stratified combustion and compression ignition homogeneous combustion are carried out in combustion modes.

The invention is not limited to the embodiments described above but appropriately susceptible to modifications within a scope not departing from the gist or the thought of the invention readable from the claims and the whole of the specification, and a control unit of an internal combustion engine, which is modified in such a manner, control means thereof, and a vehicle provided with such internal combustion engine are included in the technical scope of the invention.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An engine control unit for internal combustion engines of vehicles, in which a plurality of combustion modes are carried out, said engine control unit comprising:

detection means for directly or indirectly detecting a condition having an influence on an operation of a vehicle, in which said internal combustion engine is mounted;

vehicle influence estimation means for estimating an influence on a future operation of the vehicle on the basis of results of detection made by the detection means; and combustion switchover means for controlling to switch over a combustion mode of the internal combustion engine in advance on the basis of the influence estimated and calculated by the vehicle influence estimation means.

2. The engine control unit for internal combustion engines, according to claim 1, wherein the condition having an influence on an operation of the vehicle is based on at least one of peripheral information of the vehicle, traveling geographical information, and vehicle stability information.

3. The engine control unit for internal combustion engines, according to claim 1, wherein the plurality of combustion systems include a first combustion system being low in combustion stability but excellent in fuel economy, and a second combustion system being inferior in fuel economy to the first combustion system but high in combustion stability, and said combustion switchover means includes a control condition for switchover of a combustion mode of the internal combustion engine according to an operating state of the internal combustion engine and controls to switch a combustion mode of the internal combustion engine over to the second combustion system on the basis of an influence by the vehicle influence estimation means even when the internal combustion engine is put in an operating state to enable carrying out the first combustion system.

4. The engine control unit for internal combustion engines, according to claim 3, wherein said internal combustion engine is a gasoline engine, the first combustion system comprises compression ignition combustion, and the second combustion system comprises spark ignition combustion and the compression ignition combustion.

* * * * *